US010391409B2

(12) United States Patent
Norquist et al.

(10) Patent No.: US 10,391,409 B2
(45) Date of Patent: Aug. 27, 2019

(54) ROTATABLE PLAY DEVICE

(71) Applicant: PlayCore Wisconsin, Inc., Chattanooga, TN (US)

(72) Inventors: Thomas Robert Norquist, Fort Payne, AL (US); Kim Corvin Blackwood, Boaz, AL (US)

(73) Assignee: PLAYCORE WISCONSIN, INC., Chattanooga, TN (US)

( * ) Notice: Subject to any disclaimer, the term of this patent is extended or adjusted under 35 U.S.C. 154(b) by 0 days.

(21) Appl. No.: 15/877,015

(22) Filed: Jan. 22, 2018

(65) Prior Publication Data

US 2018/0140958 A1 May 24, 2018

Related U.S. Application Data

(63) Continuation of application No. 15/363,820, filed on Nov. 29, 2016, now Pat. No. 9,873,057.

(60) Provisional application No. 62/406,791, filed on Oct. 11, 2016.

(51) Int. Cl.

| | |
|---|---|
| ***A63G 1/28*** | (2006.01) |
| ***A63G 9/12*** | (2006.01) |
| ***A63G 1/14*** | (2006.01) |

(52) U.S. Cl.

CPC ..... *A63G 1/28* (2013.01); *A63G 1/14* (2013.01); *A63G 9/12* (2013.01)

(58) Field of Classification Search

CPC ... A63G 9/00; A63G 9/02; A63G 9/04; A63G 9/14; A63G 9/16; A47D 13/00; A47D 13/105; A47D 13/107

USPC ..... 472/20, 29–33, 118–125; 297/273, 279

See application file for complete search history.

(56) References Cited

U.S. PATENT DOCUMENTS

| | | | | |
|---|---|---|---|---|
| 519,178 | A * | 5/1894 | Douglas et al. | A63G 1/28 472/33 |
| 1,142,970 | A | 6/1915 | Koehler | |
| 2,765,168 | A | 10/1956 | Taylor | |
| 3,090,617 | A | 5/1963 | Hjelte et al. | |
| 3,397,881 | A | 8/1968 | Hedgecock | |
| 4,978,120 | A | 12/1990 | Greenwood | |
| 5,883,545 | A | 3/1999 | Boyd | |
| 8,033,922 | B1 | 10/2011 | Marquez | |
| 8,313,388 | B2 | 11/2012 | Ochi | |
| 8,715,095 | B2 | 5/2014 | Hsieh | |

* cited by examiner

*Primary Examiner* — Kien T Nguyen
(74) *Attorney, Agent, or Firm* — McAndrews, Held & Malloy, Ltd.

(57) ABSTRACT

Embodiments of the present disclosure are directed to a rotatable play device that comprises a central support post, a hub rotatably mounted to an upper end of the central support post, and a plurality of arms attached to the hub, wherein a seat is suspended from the distal end of each of the plurality of arms. Rotation of the hub about the central support post causes the plurality of seats to rotate around the central support post in a substantially circular rotation path. In addition, each of the seats may be configured to swing in substantial alignment with the circular rotation path. Each of the seats may also be configured to have at least a partially restricted range of motion toward the central support post, away from the central support post, or both.

20 Claims, 9 Drawing Sheets

ROTATABLE PLAY DEVICE

This application is a continuation of U.S. patent application Ser. No. 15/363,820, filed on Nov. 29, 2016, which claims priority to U.S. Provisional Patent Application No. 62/406,791, filed on Oct. 11, 2016, the entireties of both of which are incorporated by reference herein.

BACKGROUND OF THE INVENTION

Swings are an integral part of the playground experience. Yet swings are conventionally aligned either next to one another in a row so that children may all swing in the same direction or in a large circle so that children may all swing toward the center of the circle. Moreover, conventional swings generally offer a single play opportunity—the act of swinging. The rotatable play device of the present disclosure provides a new play opportunity by which a user is able to experience the act of swinging in combination with an additional social play opportunity—shared rotation.

SUMMARY OF THE INVENTION

Embodiments of the present disclosure are directed to a rotatable play device that comprises a central support post, a hub rotatably mounted to an upper end of the support post, and a plurality of arms attached to the hub, wherein each of the plurality of arms supports a swing seat. Each of the arms may have a proximal end attached to the hub and a distal end that is configured to support a swing seat. The rotatable play device may also comprise a plurality of seats, with each swing seat being suspended from the distal end of an arm. Rotation of the hub about the central support post causes the plurality of seats to move around the central support post in a substantially circular swing path.

In some embodiments, the rotatable play device may also comprise one or more motion limiters. A motion limiter is configured to limit the movement of at least one of the plurality of seats in at least one direction. For example, the motion limiter may limit movement of a seat in a direction toward the support post, a direction away from the support post, or both. In some embodiments, for example, the motion limiter may be configured so that the seat cannot substantially swing toward the support post. For instance, the motion limiter may confine a seat to a range of motion toward the central support post of 10° or less, relative to a vertical axis, alternatively 5° or less, alternatively 2° or less. Similarly, in some embodiments, the motion limiter may be configured so that movement of the seat away from the central support post is limited to a desired degree. For instance, the motion limiter may confine a seat to a range of motion away from the central support post of 45° or less, relative to a vertical axis, alternatively 40° or less, alternatively 35° or less, alternatively 30° or less.

One or more of the plurality of seats may be connected to an arm by a motion limiter. In some embodiments, for example, each of the plurality of seats may be connected to an arm by a motion limiter. For instance, a mounting element of a seat may comprise a shaft and a distal end portion of an arm may comprise a hub. The shaft and the hub may be configured so the shaft rotates inside the hub only within a defined range.

In addition to the plurality of seats rotating in a circular swing path around the central post, one or more of the plurality of seats may also be configured to swing in a "to and fro" manner. For instance, at least one of the plurality of seats may be configured to swing to and fro in a direction that is in substantial alignment with the circular swing path around the central support post. In some embodiments, each of the plurality of seats may be configured to swing to and fro in substantial alignment with the circular swing path around the central support post. In this manner, the rotatable play device allows a user to experience the act of swinging in combination with movement along the circular swing path provided by rotation of the hub about the central support post.

Each of the plurality of seats may be selected to provide a unique play experience. In some embodiments, one or more of the seats may comprise a disc seat that is suspended by a flexible cable. One or more of the seats may also be configured for a child with limited physical abilities or for a young child such as a child of infant or toddler age. For instance, one or more of the seats may include some manner of restraint that prevents the child from falling from the seat and/or some manner of support that assists the child in sitting in an upright position. Non-limiting examples of seats of this sort include bucket swing seats, chair swing seats, and inclusive play seats.

In some embodiments, the central support post may extend vertically from the play surface (e.g., the ground) and the hub may define a rotation axis that is substantially aligned with a vertical axis. Where the rotation axis is aligned with a vertical axis, the plurality of seats may rotate around the central support post in a substantially circular swing path that is parallel with the play surface. In other embodiments, however, the hub may define a rotation axis that is tilted relative to the vertical axis. For instance, the hub may define a rotation axis that is tilted at an angle between about 1° and about 20° relative to a vertical axis, alternatively between about 5° and about 15°. Where the rotation axis is tilted relative to the vertical axis, the plurality of seats may rotate around the central support post in a substantially circular swing path that is not parallel with the play surface. Rather, as a seat travels along the circular swing path, the seat will be lifted higher off of the play surface (e.g., the ground) when on a first side of the central support post than when on the second side of the central support post. These tilted embodiments may allow one or more users to maintain rotation of the hub in a largely self-sustaining manner, such as by a coordinated shifting of weight during rotation through the substantially circular swing path.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

Figure 1:
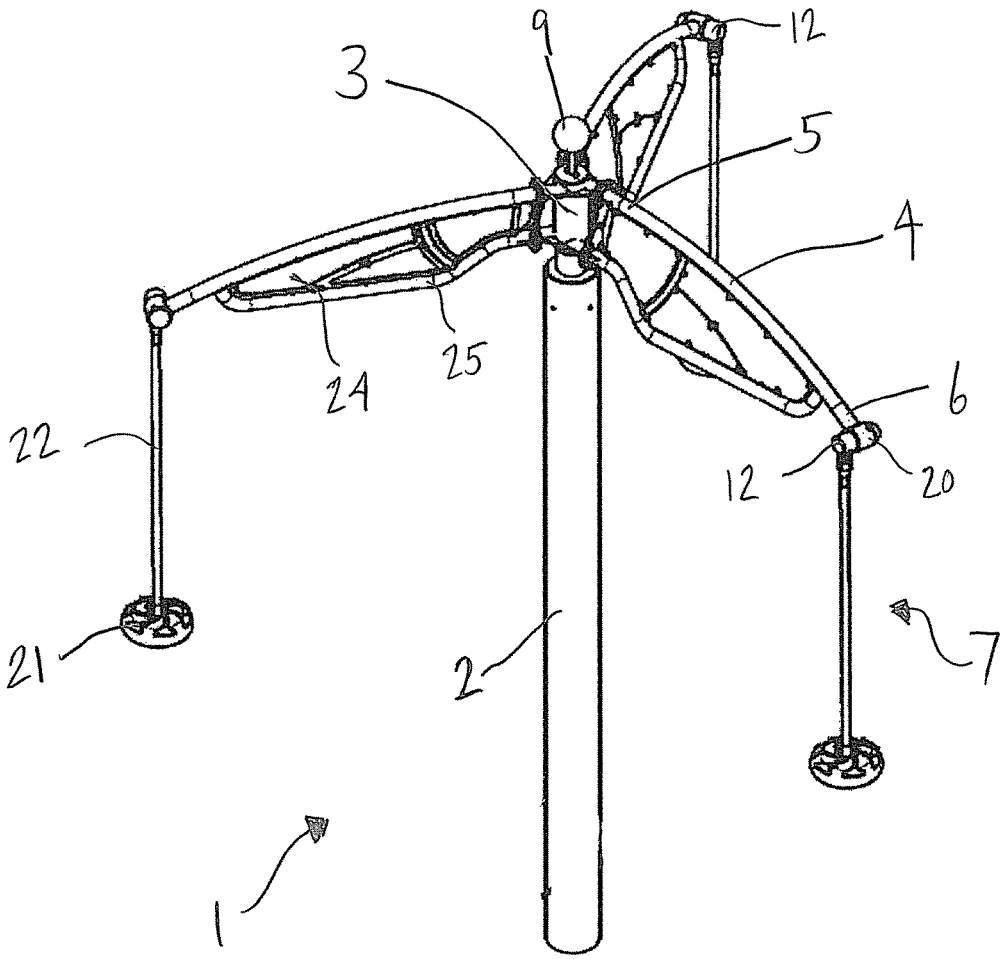
FIG. 1 is a perspective view of an embodiment of the rotatable play device.

Embodiments of the present disclosure are directed to a play device 1 in which a plurality of seats 7 rotate around a central support post 2 in a substantially circular swing path. An embodiment of a play device 1 in accordance with the present description is shown in FIGS. 1 to 3.

The play device 1 comprises a central support post 2 and a hub 3 which is rotatably mounted to an upper end of the central support post. The play device 1 also comprises a plurality of arms 4 extending away from the central support post 2. Each arm 4 has a proximal end 5 that is attached to the hub 3 and a distal end 6 that is configured to support a seat 7. The play device 1 also comprises a plurality of seats 7, with each swing seat being suspended from the distal end 6 of one of the arms 4.

The play device 1 is configured so that one or more users may cause the hub 3 to rotate, causing the seats 7 to rotate around the central support post 2 in a substantially circular swing path. This rotation can be initiated, for example, by using ones legs to push off the play surface (e.g., the ground) while seated on one of the seats 7 or by moving one of the swing seats through a portion of the circular swing path before sitting on the seat. A semi-continuous rotation can be maintained by one or more users simply by occasionally pushing off the play surface in the direction of the rotation. The rotation can also be initiated or maintained by a caretaker or other bystander providing an assistive force, e.g. a push. The play device 1 preferably comprises no motors and that rotation is initiated and maintained solely by the physical action of users and/or bystanders. It is also preferable that rotation of the plurality of seats 7 through the substantially circular swing path may be easily achieved by users of many different ages, so that children of many ages can utilize the play opportunities presented by the play device 1.

Figure 2:
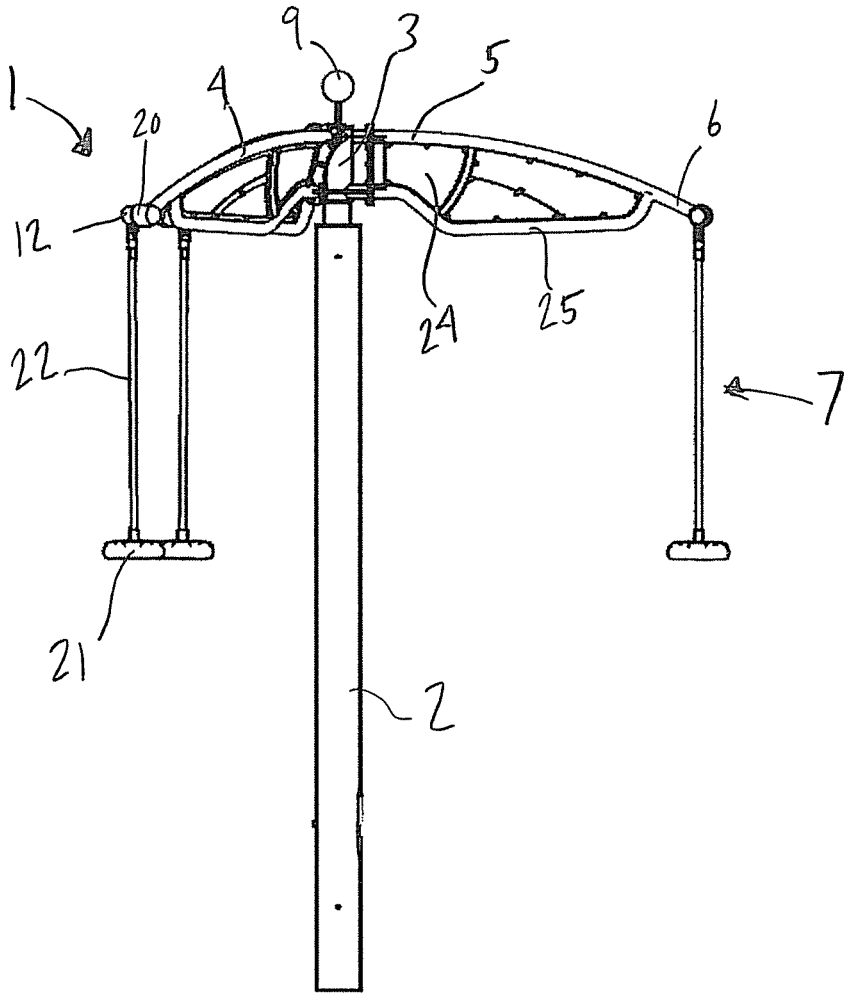
FIG. 2 is an elevation view of an embodiment of the rotatable play device.
Figure 3:
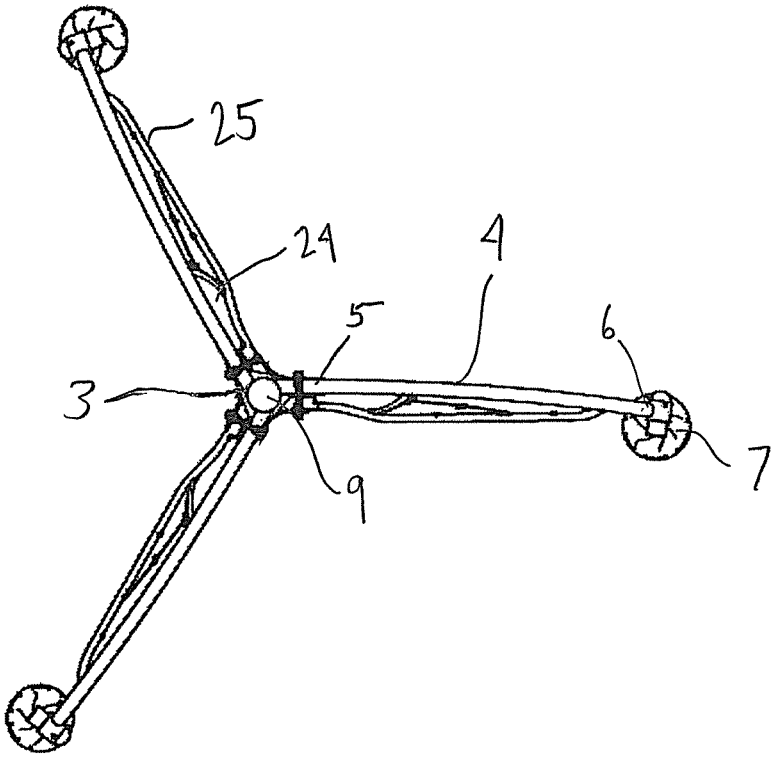
FIG. 3 is a top plan view of an embodiment of the rotatable play device.

In some embodiments, such as that illustrated in the FIGS. 1 to 3, the play device 1 may have three arms 4. In other, non-illustrated, embodiments, the play device 1 may have a different number of arms 4. For instance, the play device 1 may comprise two arms 4, four arms, five arms, six arms, seven arms, eight arms, or more. In some embodiments, the play device 1 may have greater than two arms 4. The number of arms 4 may be selected to provide a play experience that may be shared by a desired number of children. As the number of arms 4 is increased, however, the length of the arms may need to be increased in order to ensure that the seats 7 are positioned at a safe and fun distance from one another. In addition to requiring valuable playground space, this may require each of the arms 4 to have an increased strength. A play device 1 having between three and five arms 4, and in particular a play device having three arms, has been found to be particularly functional.

The plurality of arms 4 may desirably be equidistantly spaced from one another. For instance, the proximal end 5 of each arm may be equidistantly spaced around the circumference of the hub 3. The hub 3 is preferably configured so that the weight of the plurality of arms 4 and the plurality of seats 7 is substantially evenly distributed. In this way, the play device 1 may be easily operated to provide rotation in a semi-continuous manner with the exertion of little effort. By substantially evenly distributing the weight among the plurality of arms 4, rotation of the hub 3 about the central support post 2 may easily be initiated and maintained by one or more users. For instance, in the embodiment shown in FIGS. 1 to 3, semi-continuous rotation may easily be achieved by a single user, by two users, or by three or more users. Where each of the plurality of seats 7 is substantially identical, such as is shown in FIGS. 1 to 3, the weight may be substantially evenly distributed by securely attaching each of the plurality of arms 4 to the hub 3. Where one or more of the plurality of seats 7 differs from another, additional steps may be required. For instance, additional weight may be added to or removed from one or more of the arms 4 in order to counteract a relatively light seat 7 or a relatively heavy seat 7.

In some embodiments, such as that illustrated in FIGS. 1 to 3, the hub 3 may define a rotation axis that is substantially aligned with a vertical axis. Where the rotation axis is aligned with a vertical axis, the plurality of seats 7 may rotate around the central support post 2 in a substantially circular swing path that is parallel with the play surface (i.e., the plane defined by the circular swing path is parallel with the play surface). In other, non-illustrated, embodiments, the hub 3 may define a rotation axis that is tilted relative to the vertical axis. For instance, the hub 3 may define a rotation axis that is tilted at an angle between about 1° and about 20° relative to a vertical axis, alternatively between about 5° and about 15° relative to a vertical axis. Where the rotation axis is tilted relative to the vertical axis, the plurality of seats 7 may rotate around the central support post 2 in a substantially circular swing path that is not parallel with the play surface (i.e., the plane defined by the circular swing path is not parallel with the play surface). Rather, as a seat 7 travels along the circular swing path, the seat 7 will be lifted higher off of the play surface (e.g., the ground) when on a first side of the central support post 2 than when on the second side of the central support post. These tilted embodiments may allow one or more users to maintain rotation of the hub 3 in a largely self-sustaining manner, such as by a coordinated shifting of weight during rotation through the substantially circular swing path.

Figure 4:
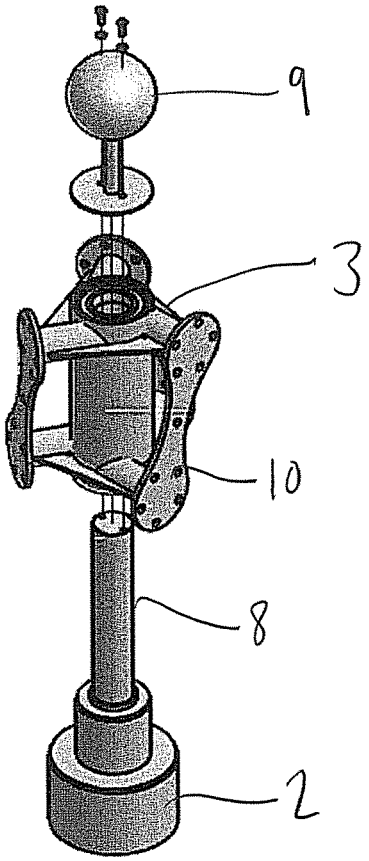
FIG. 4 is an exploded view of the central hub and the upper end of the support post in accordance with an embodiment of the rotatable play device.

The hub 3 may be rotatably mounted to an upper end of the support post 2 in any number of manners, as could be envisioned by a person of ordinary skill in the art from the present disclosure. One non-limiting manner of rotatably mounting the hub 3 to the upper end of the support post 2 is shown in FIG. 4. In this embodiment, the hub 3 is supported by the upper end of the central support post 2. The hub 3 comprises an internal bearing assembly which surrounds and rotates on a head 8 of the upper end of the support post 2. The hub 3 may be secured to the upper end of the support post 2 by a top cover 9. As illustrated in FIG. 4, for instance, the top cover 9 may be secured to the head 8 of the support post 2 using one or more conventional fasteners. The top cover may take on any shape and size, and may be selected for instance to coincide with a particular playground theme.

In embodiments in which the hub defines a rotation axis that is tilted with respect to vertical, one of the support post 2 and the hub 3 may comprise a tilted portion. Alternatively, the hub 3 may be mounted to the upper end of the support post 2 via one or more tilted connecting elements. For example, a connecting element having a head portion tilted at the desired rotation angle may be secured to the upper end of the substantially vertical support post 2 and the hub 3 may comprise an internal bearing assembly that is configured to rotate on the head of the connecting element to produce a rotation axis that is tilted with respect to vertical. Alternatively, the connecting element may have an internal bearing assembly that surrounds and rotates on a head 8 of the upper end of the substantially vertical support post 2 and the hub 3 may be secured to a tilted portion of the connecting element so that rotation of the connecting element about the vertical axis is translated to provide a rotation axis that is tilted with respect to vertical.

Figure 5:
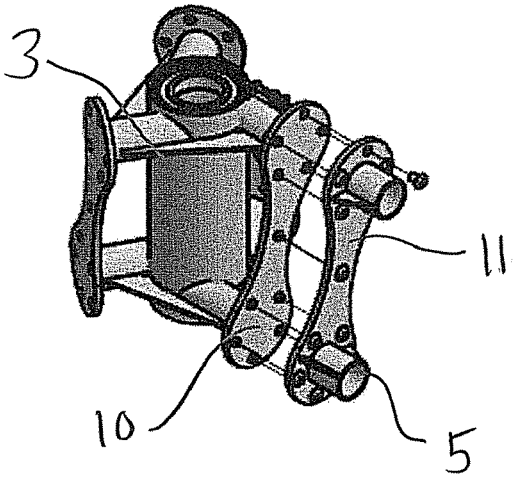
FIG. 5 is an exploded view of the central hub and the proximal end of an arm in accordance with an embodiment of the rotatable play device.

The plurality of arms 4 may be attached to the hub 3 in any number of manners, as could be envisioned by a person of ordinary skill in the art from the present disclosure. One non-limiting manner of attaching the proximal end 5 of each of the arms 4 to the hub 3 is shown in FIG. 5. In this embodiment, the hub comprises a number of mounting plates 10 that correspond with the number of arms 4 of the play device 1. The proximal end 5 of each arm 4 comprises a mounting plate 11 that is configured for attachment to one of the hub's mounting plates 10. The mounting plate 11 may be affixed to the distal end 5 of the arm 4, such as through conventional methods, or the mounting plate may be integral with the distal end of the arm. As in the embodiment shown in FIG. 5, the mounting plate 11 may extend beyond and create a periphery that surrounds the framework of the arm 4 to provide a readily accessible surface for securing to the hub 3. Similarly, the mounting plate 10 on the hub 3 may extend from the hub so as to have a readily accessible back surface for the attachment of a fastener component (e.g., bolts or nuts). Inclusion of these easily-accessible surfaces on each of the mounting plates 10, 11 provides for an increased ease of assembly.

Moreover, each of the mounting plates 10, 11 may have a relatively large surface area configured for fastening of the arm 4 to the hub 3 at a plurality of locations in order to ensure that weight is substantially evenly distributed throughout the plurality of arms. For instance, each of the hub's mounting plates 10 may extend substantially the entire height of the hub 3. The mounting plate 11 on the proximal end 5 of the arm 4 may also extend substantially the height of the hub 3. The two mounting plates 10, 11 may be secured together using one or more conventional fasteners, such as bolts or the like. To ensure a substantially even distribution of weight, the two mounting plates 10, 11 are preferably secured together by a plurality of fasteners. For instance, in the embodiment shown in FIG. 5, the two mounting plates 10, 11 are secured together with multiple fasteners positioned around each portion of the framework of the arm 4 and along the entire height of the mounting plates. Different numbers and positioning of fasteners is also contemplated, especially where the mounting plates 10, 11 may have different configurations from that shown in FIG. 5. It is also contemplated that, in some embodiments, each of the arms 4 may be integrally formed with the hub 3.

Figure 6:
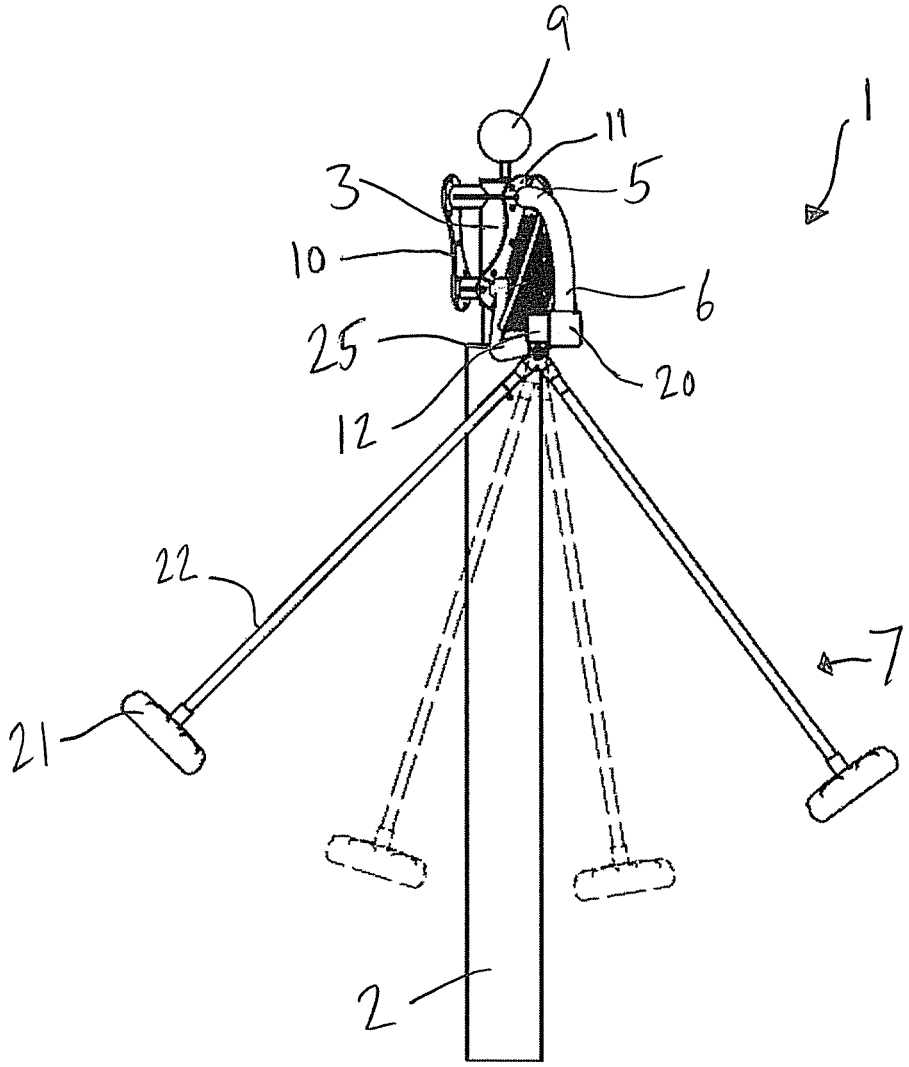
FIG. 6 is an elevation view of the rotatable play device, showing a swing seat that is configured to swing in substantial alignment with the circular swing path in accordance with an embodiment of the rotatable play device.

In addition to rotation around the central support post 2, one or more of the seats 7 may also be configured to swing from the distal end 6 of the arm 4. For instance, one or more of the seats 7 may be configured to swing in a "to and fro" motion in one or more directions. In some embodiments, one or more of the seats 7 may be configured to swing to and fro in substantial alignment with the circular swing path. A seat 7 swinging in a to and fro manner in substantial alignment with the circular swing path is shown in FIG. 6. Because the swinging motion is in substantial alignment with the circular swing path, the swinging motion does not itself bring the seat either substantially closer to or substantially farther away from the central support post 2. Note that in some embodiments, such as where the seat 7 is suspended by a flexible cable for example, the manner by which the seat 7 is suspended from the proximal end 6 of the arm 4 necessarily allows for a small degree of movement of the seat in multiple (e.g., all) directions. While a user may utilize this inherent flexibility to slightly alter the "to and fro" motion, the overall motion would still be considered to be in substantial alignment with the circular swing path. In some embodiments, each of the plurality of seats 7 may be configured to swing in a "to and fro" manner as described above.

Figure 7:
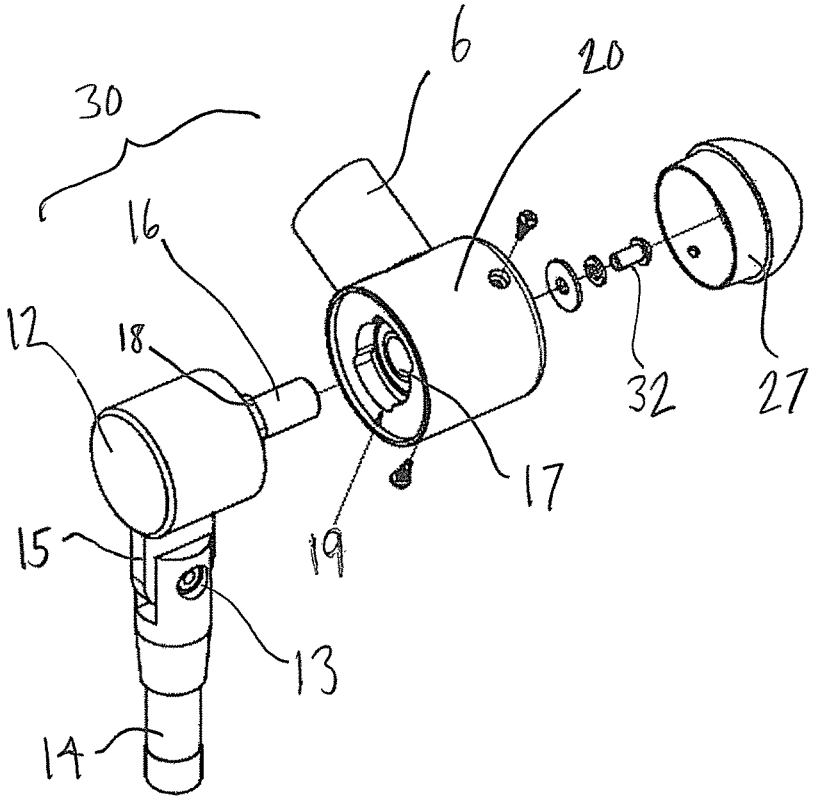
FIG. 7 is an exploded view of the distal end of an arm and the seat mounting element, showing a motion limiter in accordance with an embodiment of the rotatable play device.

One or more of the seats 7 may be configured to swing in a "to and fro" manner in any number of ways, as could be envisioned by a person of ordinary skill in the art from the present disclosure. In some embodiments, the seat assembly 7 may comprise a mounting element 12 having a hinge 13 that provides for a "to and fro" swinging motion. An example of such a mounting element 12 is shown in FIG. 7. In the embodiment illustrated in FIG. 7, a seat suspension component 14 is connected to a portion of the mounting element 12 by a hinge 13. In particular, the mounting element 12 comprises a downward-extending portion 15 that mates with the seat suspension component 14 in a hinged manner. In the embodiment illustrated in FIG. 7, the seat suspension component 14 is affixed to the first end of a flexible cable 22 and the second end of the flexible cable is attached to a disc seat 21. Accordingly, movement of the seat suspension component 14 about the hinge 13 may be caused by (and provides for) a swinging motion of a user sitting on the disc seat 21.

In some embodiments, such as that illustrated in FIG. 7, the hinge 13 only allows "to and fro" swinging in a substantially single direction, for example in a plane that substantially corresponds with the circular swing path defined by rotation of the hub 3 about the central support post 2. For example, the hinge 13 may be configured (for example by being aligned substantially parallel to the longitudinal axis of the arm 4) so that the seat suspension component 14 moves about the hinge to create a swinging motion in a direction that is perpendicular with the arm. Thus, as the arm 4 rotates about the central support post 2, the swinging motion will always be substantially aligned with the circular swing path created by the rotation of the hub 3 about the central support post 2. In some embodiments, the hinge 13 assembly may also be configured to restrict the degree the height to which the seat may swing during the "to and fro" swinging action. For example, the hinge 13 assembly may only allow the seat to swing 50° or less relative to a vertical axis (meaning that the maximum angle formed between the swing seat and a vertical axis is between 0° and 50°), alternatively 45° or less, alternatively 40° or less, alternatively 35° or less, alternatively 30° or less, or the like.

Where one or more of the seats 7 is configured to swing in a "to and fro" motion, it may become important that the play device 1 meet all requisite standards for playground swings, such as all ASTM standards for playground swings.

In some embodiments, one or more of the seats 7 may be configured to swing in a direction toward the central support post 2, away from the central support post, or both. However, in some embodiments, the play device 1 may comprise one or more motion limiters 30. A motion limiter 30 is configured to limit the range of motion of a seat 7. For example, one or more seats 7 may be equipped with a motion limiter 30 that is configured to limit the seat's range of motion in a direction toward the central support post, in a direction away from the central support post, or both. In some embodiments, each of the plurality of seats 7 may comprise a motion limiter 30.

In some embodiments, it may be desirable to limit motion of one or more of the swing seats 7 toward the central support post 2 so as to avoid dangerous situations and/or possible collisions. In some embodiments, the motion limiter 30 may be configured so that one or more of the seats 7 cannot substantially swing in a direction toward the central support post 2. Note that in some configurations, such as where the seat 7 is suspended by a flexible cable for example, the manner by which the seat 7 is suspended from the proximal end 6 of the arm 4 may necessarily allow for a small degree of movement of the seat in multiple (e.g., all) directions. While a user may utilize this inherent flexibility to achieve a small degree of movement toward the central support post 2, the motion limiter 30 may nevertheless be understood as configured such that the seat 7 cannot substantially swing in a direction toward the central support post. In some embodiments, the motion limiter 30 may be configured so that movement of a seat 7 in a direction toward the central support post 2 is limited to 20° or less relative to a vertical axis (meaning that the maximum angle formed between the swing seat and a vertical axis is between 0° and 20°, alternatively 15° or less, alternatively 10° or less, alternatively 5° or less, alternatively 2° or less.

Figure 10:
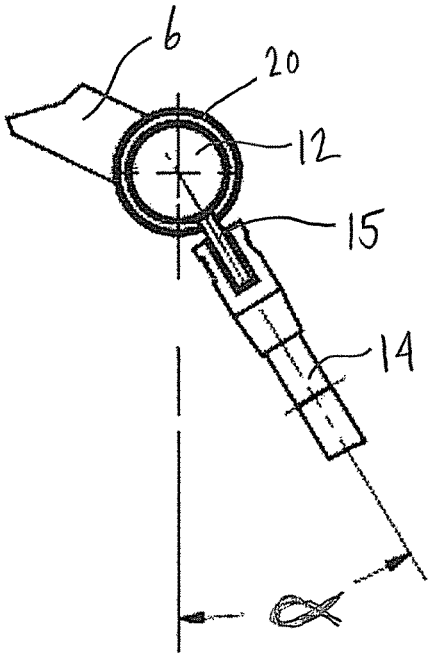
FIG. 10 is a side elevation view of the distal end of the arm and the seat mounting element, demonstrating the operation of a motion limiter in accordance with an embodiment of the rotatable play device.

In some embodiments, it may be desirable to limit motion of one or more of the swing seats 7 away from the central support post 2. Motion of the seats 7 away from the support post 2 will naturally occur due to centripetal forces caused by rotation of the swing seats around the central support post. However, it may be desirable to limit this motion for the safety of users and/or bystanders. Accordingly, the motion limiter 30 may be configured so that a swing seat 7 has a limited range of motion in a direction away from the support post 2. In some embodiments, for example, the motion limiter 30 may be configured so that movement of the seat 7 in a direction away from the support post 2 is limited to an angle $\alpha$ relative to a vertical axis. This effect is illustrated in FIG. 10. For instance, the motion limiter 30 may be configured so that movement of the swing seat in a direction away from the support post 2 is limited to 45° or less relative to a vertical axis (meaning that the maximum angle formed between the swing seat and a vertical axis is between 0° and 45°), alternatively 40° or less, alternatively 35° or less, alternatively 30° or less, alternatively 25° or less, alternatively 20° or less.

In some embodiments, it may be desirable to limit motion of the swing seats 7 both in a direction toward the central support post 2 and in a direction away from the central support post. In some embodiments, for example, the motion limiter 30 may be configured to limit motion of the swing seat 7 toward the central support post 2 to a first degree, such as described above, and to limit motion of the swing seat away from the central support post to a second degree, such as described above. In the embodiment illustrated in FIG. 10, for example, the motion limiter 30 is configured so that the seat 7 cannot swing in a direction toward the central support post 2 (to the left of the Figure) and so that the seat is limited to a swinging motion within an angle of 30° from vertical in a direction away from the central support post (to the right of the Figure).

The motion limiter 30 may take on any of a number of configurations. In some embodiments, the seat assembly 7 may be connected to the distal end 6 of the arm 4 by a motion limiter 30. For instance, a mounting element 12 of the seat assembly 7 may be attached to a distal end component 20 of the arm through a motion limiter 30, which may be configured so that the mounting element 12 may only rotate within a predetermined and defined range in relation to the distal end component 20. An example of such an assembly is shown in FIG. 7.

As shown in FIG. 7, the mounting element 12 of the seat assembly 7 may comprise a shaft 16 and the distal end component 20 may comprise an aperture 17. For example, the shaft 16 may be integral with and extend from an end of the mounting element 12. The distal end component 20 may comprise an internal element defining the aperture 17. The internal element may be integral with the distal end component 20 or it may be secured within the distal end component by any conventional manner, such as friction fit, one or more conventional fasteners, or the like. Additionally, the distal end component 20 may be either integral with the distal end 6 of the arm 4 or secured to the distal end of the arm, such as by one or more conventional fasteners or the like. In some embodiments, the internal element may be secured within the distal end component 20 and the distal end component may be affixed to the distal end 6 of the arm 4 by the same one or more fasteners.

Figure 8:
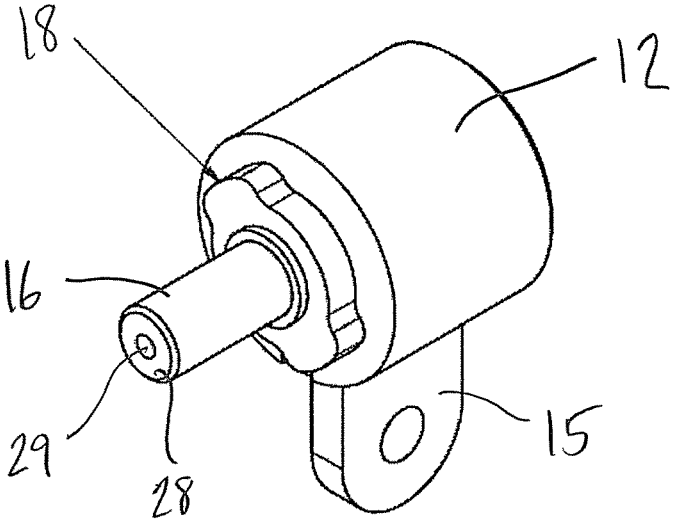
FIG. 8 is a perspective view of a seat mounting element in accordance with an embodiment of the rotatable play device.

The shaft 16 may be rotatably affixed to the distal end component 20. For instance, the shaft 16 may extend into and substantially through the aperture 17, such that the front surface 28 of the shaft 16 may be affixed to the distal end component 20 by one or more conventional fasteners, such as screws and the like. As illustrated in FIG. 8, for example, the front surface 28 of the shaft 16 may comprise an opening 29 having an internal thread. Accordingly, as illustrated in FIG. 7, a screw 32 (having an external thread) may be inserted through a portion of the distal end component 20 and into the opening 29 on the front surface 28 of the shaft 16, securing the mounting element 12 to the distal end component 20 (but allowing for rotation of the mounting element 12 about the distal end component 20). A cover element 27 may be placed over the fastener, e.g. the screw 32, in order to protect it from both the environment and potential tampering.

Figure 9:
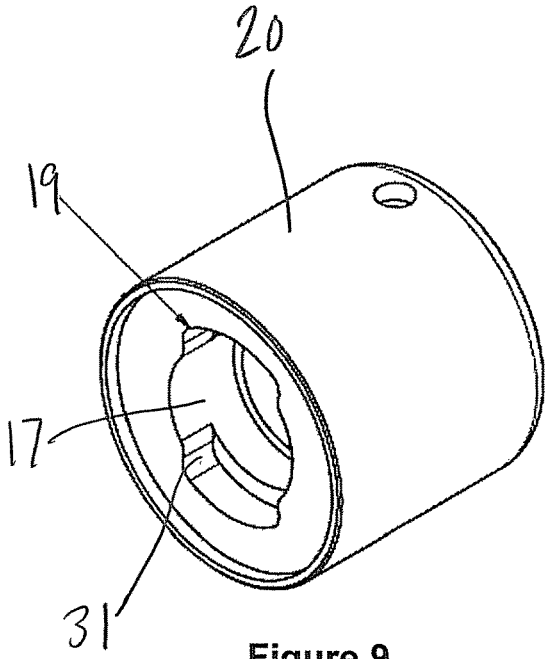
FIG. 9 is a perspective view of a distal end component of an arm in accordance with an embodiment of the rotatable play device.

The shaft 16 and the aperture 17 may be configured so that the shaft rotates inside the aperture within a predetermined and defined range. Rotation of the shaft 16 within the aperture 17 may be restricted in a number of ways. As shown in FIG. 8, for instance, the mounting element 12 may have one or more projecting portions 18. Although the projecting portions 18 of the mounting element 12 are shown extending from the body of the mounting element 12, in other embodiments the one or more projecting portions may extend from a portion of the shaft 16 itself. As shown in FIG. 9, the aperture 17 may have one or more cutaway portions 19 that are designed to accept the one or more projecting portions 18. The one or more cutaway portions 19 define a length within which the one or more projecting portions 18 are able to travel. At either end of that defined length, the cutaway portion comprises a stop element 31, such as a ledge or the like. When the mounting element 12 rotates to a desired maximum degree, the one or more projecting portions 18 abut against stop elements 31 of the one or more cutaway portions 19, which prevents rotation of the mounting element beyond that desired maximum degree. Accordingly, rotation of the mounting element 12 is restricted to occur only within the lengths of the one or more cutaway portions 19.

While the embodiment illustrated in FIGS. 7 through 9 comprises two complementary projections 18 and cutaways 19, other embodiments may comprise only one complementary projection 18 and cutaway 19. Yet other embodiments may comprise three, four, or greater than four complementary projections 18 and cutaways 19.

The play device 1 may comprise any number of different types of seats 7, as could be envisioned by a person of ordinary skill in the art from the present disclosure. In some embodiments, such as that illustrated in FIGS. 1 to 3, one or more of the seats 7 may comprise a disc seat 21. The disc seat 21 may comprise a relatively hard central base that is surrounded by a relatively soft material, the relatively soft material providing cushioning in case a seat were to come into contact with a person during rotation and/or a swinging motion. In some embodiments, for example, a disc seat 21 may comprise an aluminum base that is surrounded by a foamed material. The foamed material may also be coated with a sealant that is configured to withstand playground environment and use. A disc seat 21 having this construction may be configured to meet requisite ASTM impact standards.

Other types of swing seats 7, including but not limited to those described below, are also contemplated. For instance, one or more of the seats 7 may comprise a belt swing seat or a board swing seat, which are suitable for use by children and adults alike. In some embodiments one or more of the seats 7 may comprise a seat that is configured for use by a child of infant or toddler age and which provides some manner of restraint that assists in preventing the child from falling from the seat or by providing some support that assists the child in sitting upright in the seat. Some non-limiting examples of swing seats of this sort include bucket swing seats and chair swing seats.

A bucket swing seat is any seat having at least a segment of the seat that is generally shaped like a bucket, with the segment providing a restraint on the forward, backward, or lateral movement of the occupant. A full bucket seat, for example, is a bucket seat that has a peripheral wall extending around the perimeter of the seat. The full bucket seat typically comprises holes for a child's legs and requires the caretaker to lift a child and place him or her into the seat. Full bucket seats are sold, for example, under the trade names GameTime® Enclosed Tot Seat and Play&Park Structures® Fully Enclosed Tot Seat. A half bucket seat is a bucket seat that has a peripheral wall that extends only around a portion of the perimeter. Typically, the peripheral wall provides a restraint on at least the backward movement of the occupant. A half bucket seat may also include a front guard that, when closed, restrains the forward movement of the occupant.

A chair swing seat is a child swing seat having at least a bottom support and a back support, calling to mind the shape of a chair. In various embodiments, a chair swing seat may also, but does not necessarily, include a front guard, which restrains the forward movement of the child. The front guard may be integrally formed with or permanently affixed to the chair, in which case, the chair and font guard preferably comprise openings through which a child's legs extend. Preferably, the front guard is moveable between an open position, in which the child may easily be placed into or taken out of the seat, and a closed position. In some embodiments, the front guard comprises a solid component, for example a plastic or cushioned component. Solid component front guards, for example, may slide or rotate between an open and closed position. Alternatively, solid component front guards may be detached from the seat for child loading and reattached to the seat to act as a restraint. In other embodiments, the front guard may comprise a belt or harness that is fastened or clasped in place to form a restraint. Models of chair swing seats are sold, for example, under the trade names Play&Park Structures® Made-for-Me Swing Seat, BigToys® Made-for Me Swing Seat, Play&Park Structures® One-for-All Swing Seat, and BigToys® One-for-All Swing Seat.

Figure 11:
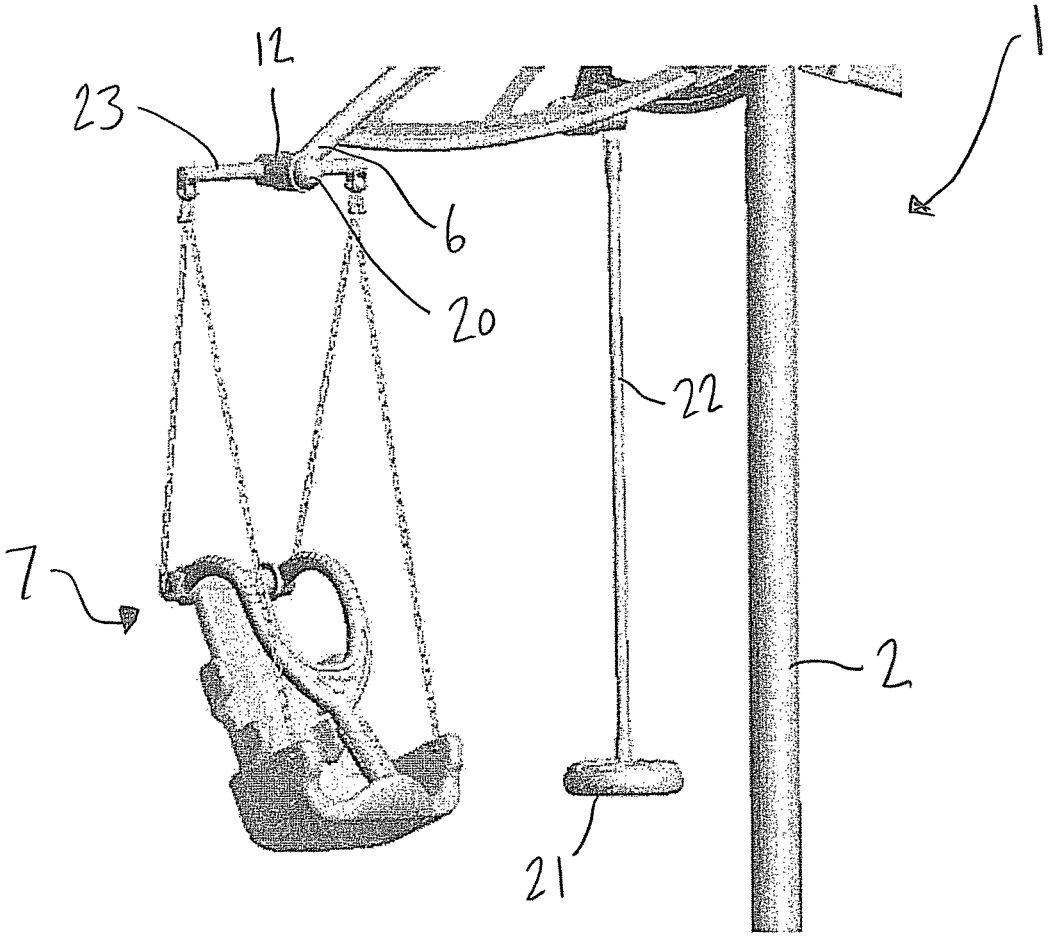
FIG. 11 is a perspective view of an embodiment of the rotatable play device in which one of the seats is configured for a child with limited physical abilities.

In some embodiments, the child swing seat may comprise a swing seat 7 that is adapted for use by children with special needs, sometimes referred to as inclusive play or adaptive swing seats. Inclusive play swing seats, for example, are configured for children that require additional support and typically have a high back, wing support, and an adjustable harness that helps a child maintain a neutral body position and minimizes fatigue. Models of inclusive play swing seats are sold, for example, under the trade names GameTime® Adaptive Swing Seat and GameTime® Zero-G Swing Chair. An embodiment of a play device of the present disclosure comprising an example inclusive play swing seat is shown in FIG. 11. The swing seat 7 shown in FIG. 11 is a child swing chair of the sort described in detail in U.S. Pat. No. 7,892,101 B1, the entirely of which is incorporated herein by reference.

Each of the plurality of seats 7 may be suspended from the distal end 6 of the arm 4 in any of a number of different ways, as could be envisioned by a person of ordinary skill in the art from the present disclosure. In some embodiments, such as where the seat 7 comprises a disc seat as shown in FIGS. 1 to 3, it may be desirable that the seat 7 is suspended from the arm 4 by a flexible cable 22, such as that shown in the illustrated embodiments. In other embodiments, including where different types of seats 7 are utilized, the manner of suspension may be different from that shown in FIGS. 1 to 3. For example, as shown in FIG. 11, the mounting element 12 of a seat assembly 7 may comprise a crossbar 23 from which the seat is suspended. In contrast to the mounting element 12 shown in FIGS. 7 and 8, a mounting element comprising a crossbar 23 provides multiple suspension points from which the seat may be suspended. Various types of swing seats 7 may be suspended from the crossbar 23 using two or more suspension points located along the length of the crossbar.

As shown in FIG. 11, the crossbar 23 may be arranged so as to be substantially parallel with the longitudinal axis of the arm 4. This provides that the swing seat 7 may be suspended from the crossbar 23 in a manner that allows for swinging of the seat in substantial alignment with the circular swing path, as described above. In other embodiments, including for example embodiments where "to and fro" swinging is not desirable, the crossbar 23 may be arranged to be substantially perpendicular to the longitudinal axis of the arm 4. The swing seat 7 may then be suspended from the crossbar 23 so as to face toward the central support post 2. In this arrangement, for example, a user of the swing seat 7 may be able to better see and interact with the users of the other seats, increasing the social play aspect of the play device 1.

In some embodiments, the play device 1 may comprise one or more additional play-enhancing features. For instance, in some embodiments, the arms 4 may comprise one or more colored, translucent panels 24. The colored, translucent panels 24 may be configured so that the sun shines through the panels to create a colored shadow on the play surface (e.g., the ground) in the vicinity of the play device 1. For instance, in some embodiments, such as the embodiment illustrated in FIGS. 1 to 3, the arm 4 may comprise a framework 25 and the colored, translucent panels 24 may be attached to the arm 4 within one or more spaces created by the framework 25. The framework 25 may take on any of a number of configurations, as could be envisioned by a person of ordinary skill in the art from the present disclosure. In the illustrated embodiment, for example, the framework 25 extends substantially below the arm and defines a plurality of different openings for the attachment of colored, translucent panels 24. In other embodiments, the framework 25 may define only a single opening for the attachment of a single panel 24.

In order to ensure that the colored ground shadow is produced in the vicinity of the play device 1, the framework 25 may be tilted relative to a vertical axis so that the sunlight shines downward through the one or more panels 24 before striking the ground in the vicinity of the play device. For instance, in some embodiments, the framework 25 may be tilted between about 5° and about 45° relative to a vertical axis, alternatively between about 5° and about 30° relative to a vertical axis, alternatively between about 10° and about 30° relative to a vertical axis, alternatively between about 10° and about 20° degrees relative to a vertical axis. The framework 25 in the embodiment illustrated in FIGS. 1 to 3 for example is tiled at an angle of about 15° degrees relative to vertical. This tilting of the framework 25 can be most clearly seen in FIG. 3.

Figure 12:
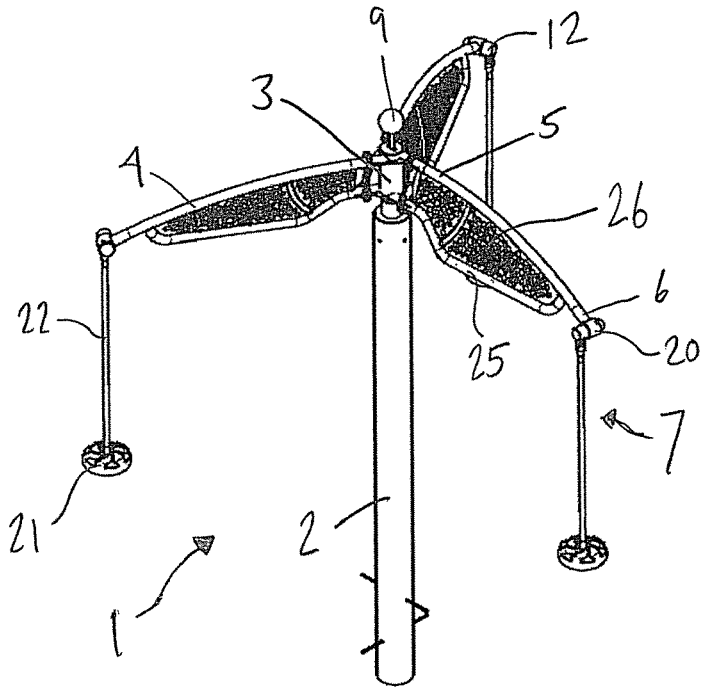
FIG. 12 is a perspective view of another embodiment of the rotatable play device.
Figure 13:
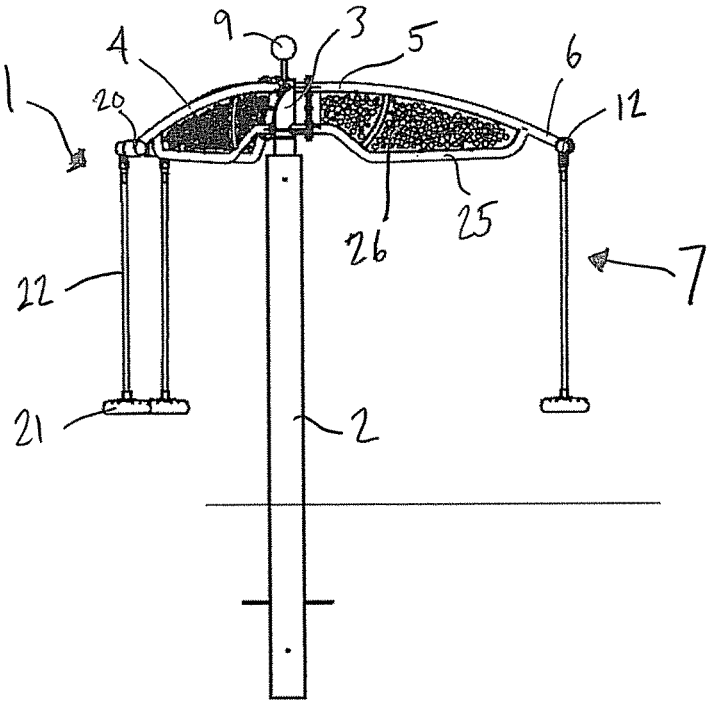
FIG. 13 is an elevation view of another embodiment of the rotatable play device.

In other embodiments, such as that illustrated in FIGS. 12 to 13, the arms 4 may comprise a framework 25 but may not comprise colored, translucent panels 24. In some embodiments, the colored, translucent panels 24 may be replaced with one or more inserts having a design that is configured to coincide with a themed playground. For instance, in the embodiment shown in FIGS. 12 to 13, the panels 24 have been replaced with perforated metal inserts 26. In other embodiments, the inserts could mimic the canopy of a forest or the leaves/branches of a tree. The variety of themed inserts that could be incorporated into the arms 4 of the play device 1 of the present disclosure is endless.

It can be seen that the described embodiments provide a unique and novel rotatable play device 1 that has a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A play device comprising:

a support post;

a hub rotatably mounted to an upper end of the support post;

a plurality of arms extending away from the support post, each arm having a proximal end attached to the hub and a distal end supporting a seat;

a plurality of seats, each seat being suspended from the distal end of an arm;

wherein the play device is configured so that one or more users may cause the hub to rotate about the support post by pushing off from the play surface, wherein rotation of the hub causes the plurality of seats to move around the support post in a substantially circular swing path;

wherein each of the plurality of seats is configured to swing in substantial alignment with the circular swing path; and wherein at least one of the plurality of seats comprises a hinge that (i) provides a to and fro swinging motion in substantial alignment with the circular swing path and (ii) restricts the height to which the seat may swing during the to and fro swinging motion.

2. The play device of claim 1, wherein the maximum angle formed between the seat and a vertical axis during the to and fro swinging motion is 50° or less.

3. The play device of claim 1, wherein the seat swings in a substantially single direction.

4. The play device of claim 1, wherein the seat is also configured to swing in a direction away from the support post due to centripetal forces caused by movement of the seat around the support post in the substantially circular swing path.

5. The play device of claim 4, wherein the motion of the seat in a direction away from the support post is limited by a motion limiter.

6. The play device of claim 5, wherein a seat mounting element is attached to a distal end of the arm through the motion limiter, the motion limiter providing a limited rotation of the seat mounting element relative to the distal end of the arm.

7. The play device of claim 1, wherein the weight is substantially evenly distributed throughout the plurality of arms.

8. The play device of claim 1, wherein the hub comprises an internal bearing assembly which surrounds and rotates on a head of the upper end of the support post.

9. The play device of claim 8, wherein the hub is secured to the upper end of the support post by a top cover.

10. The play device of claim 1, wherein the seat is suspended from the hinge by a flexible cable.

11. The play device of claim 10, wherein the seat is a disc seat.

12. The play device of claim 1, wherein at least one of the plurality of seats comprises a mounting element having a crossbar from which the seat is suspended.

13. The play device of claim 12, wherein the seat is a bucket swing seat, a chair swing seat, or an inclusive play swing seat.

14. A play device comprising:

a support post;

a hub rotatably mounted to an upper end of the support post;

a plurality of arms extending away from the support post, each arm having a proximal end attached to the hub and a distal end supporting a seat;

a plurality of seats, each seat being suspended from the distal end of an arm;

wherein the play device is configured so that one or more users may cause the hub to rotate about the support post by pushing off from the play surface, wherein rotation of the hub causes the plurality of seats to move around the support post in a substantially circular swing path;

wherein each of the plurality of seats is configured to swing in substantial alignment with the circular swing path; and wherein the hub comprises a plurality of mounting plates, and the proximal end of each of the plurality of arms comprises a mounting plate that is secured to one of the plurality of hub mounting plates.

15. The play device of claim 14, wherein the mounting plate at the proximal end of each arm creates a periphery that surrounds a framework of the arm.

16. The play device of claim 14, wherein each of the plurality of hub mounting plates extends from the hub so that the rear surface of each mounting plate is accessible.

17. The play device of claim 14, wherein each of the hub mounting plates extends substantially the entire height of the hub.

18. The play device of claim 17, wherein the mounting plate at the proximal end of each arm also extends substantially the entire height of the hub.

19. The play device of claim 14, wherein at least one of the plurality of seats comprises a hinge that (i) provides a to and fro swinging motion in substantial alignment with the circular swing path and (ii) restricts the height to which the seat may swing during the to and fro swinging motion.

20. The play device of claim 14, wherein at least one of the plurality of seats is also configured to swing in a direction away from the support post due to centripetal forces caused by movement of the seat around the support post in the substantially circular swing path; and wherein the motion of the seat in a direction away from the support post is limited by a motion limiter.

* * * * *